United States Patent [19]

Kutnyak

[11] 4,431,196

[45] Feb. 14, 1984

[54] LIGHTING ADAPTER KIT AND METHOD FOR INSTALLING LIGHTS IN A FLYING DISC

[75] Inventor: Mark R. Kutnyak, 3276A S. 7th St., Milwaukee, Wis. 53215

[73] Assignee: Mark R. Kutnyak, Milwaukee, Wis.

[21] Appl. No.: 429,784

[22] Filed: Sep. 30, 1982

[51] Int. Cl.[3] ..... A63B 65/08; A63H 27/00

[52] U.S. Cl. ..... 273/424

[58] Field of Search ..... 273/424, 425; 46/74 D

[56] References Cited

U.S. PATENT DOCUMENTS

| | | |
|---|---|---|
| 3,359,678 | 12/1967 | Headrick . |
| 3,720,018 | 3/1973 | Peterson et al. . |
| 3,786,246 | 1/1974 | Johnson et al. . |
| 3,798,834 | 3/1974 | Samuel . |
| 3,948,523 | 4/1976 | Michael . |
| 4,086,723 | 5/1978 | Strawick . |
| 4,132,031 | 1/1979 | Psyras . |
| 4,135,324 | 1/1974 | Miller et al. . |
| 4,145,839 | 3/1979 | Sampietro . |
| 4,207,702 | 6/1980 | Boatman et al. . |
| 4,248,010 | 2/1981 | Fox . |
| 4,254,575 | 3/1981 | Gould . |
| 4,255,895 | 3/1981 | LaBrecque . |
| 4,301,616 | 11/1981 | Gudgel . |
| 4,307,538 | 12/1981 | Moffit . |

OTHER PUBLICATIONS

Flying Disc manufactured and sold by Polaris Manufacturing Co.

*Primary Examiner*—Paul E. Shapiro

*Attorney, Agent, or Firm*—Quarles & Brady

[57] ABSTRACT

A kit for installing discrete light sources in a flying disc includes a self-contained lighting circuit and supporting structure and a die for punching holes in the disc in which the discrete light sources are situated. The lighting assembly unit includes a transparent membrane, some double-faced adhesive tape and a set of conductive strips sandwiched between the tape and the membrane. The discrete light sources are mounted on the underside of the distal portions of the membrane arms and are kept apart from the distal portions of the tape by non-stick removable liner segments which are also used on the underside of the double-faced tape. A method of installing the lighting unit is disclosed in which the liner is removed from the underside of the tape to attach the lighting assembly to the disc, holes are punched through the distal portions of the tape and the distal portions of the membrane arms are secured to the disc as the lighting sources are being inserted into the holes where they are seen from the top and the bottom and at points radially outward from the disc.

11 Claims, 9 Drawing Figures

LIGHTING ADAPTER KIT AND METHOD FOR INSTALLING LIGHTS IN A FLYING DISC

BACKGROUND OF THE INVENTION

1. Field of the Invention

The invention relates to illuminated flying discs of the type that are thrown and caught by people as a recreational activity.

2. Description of the Prior Art

There are various ways known in the art of flying discs for adding the feature of illumination. Perhaps the most common type of illuminated flying disc is formed of a phosphorescent material so that the disc will "glow" in dimly lighted environments. Another type of illumination is based on chemical materials carried in pods or housings added to the basic disc. A third type carries electronic light sources such as light-emitting diodes (LED's). The invention is directed to overcoming the technical problems associated with this third type of illuminated flying disc.

A typical flying disc, of the type being commercially offered, resembles an overturned dish. An upper deck of the disc includes a flat, central portion which extends radially outward to a downwardly turned leading edge. This leading edge gives the disc the profile of a wing and also forms a transition surface between the flat portion of the upper deck and a depending rim that is provided for gripping during throwing and catching actions.

Several different approaches have been taken to locating discrete light sources on such discs. Often these have been located in housings or pods attached either to the topside or the underside of the deck and usually located centrally to maintain the balance of the disc for flight. When LED's are used these are typically mounted in the depending rim so as to be visible at points radially outward of the disc. In other discs, the LED's are easily visible from the top or bottom, but special windows or other means must be provided to transmit light in the radial direction. The known prior art does not provide a construction in which the discrete light sources are located in an exposed position to be seen from all vantage points, i.e. from above, below or radially outward of the disc. Since the disc can fly through the air at various elevations relative to the thrower and catcher, it would be advantageous to provide a disc with light sources that are visible from as many directions as possible. It would also be advantageous to eliminate extra pods or housings for the light sources.

With a prior construction in which the light sources are located in the rim, there is a further problem that any exposure or projection of the light sources will interfere with gripping the disc. When the disc is caught, the electrical connections to the LED's may be damaged or still worse, there may be a minor injury to the hand of the catcher. Another problem in this prior construction is the employment of wires which are encased in a melted plastic material leading up to the connections to the discrete light sources. Although the wires were not exposed, they become brittle and subject to breakage.

There are already well-established manufacturers of the basic flying disc and the number of discs that have already been sold is probably in the millions. Since many disc owners would not want to invest in a complete new disc merely to obtain a lighting feature, there is a need for a less expensive alternative. Although lighting kits are suggested in the art, none are known which overcome the disadvantages of the prior lighted discs that are discussed above.

SUMMARY OF THE INVENTION

The invention relates to a lighting adapter kit and a method for installing lights in a flying disc. The kit provides a structure for insulating and attaching a set of conductive strips on the underside of a flying disc and for supporting a plurality of discrete light sources that are situated in holes in the disc.

The support structure includes a central base and a plurality of arms extending radially outward from the base. Power source retaining means are attached to the membrane base to house a power source and provide electrical connections between the power source and a circuit formed by the conductive strips. The kit provides a segmented liner releasably attached to the underside of double-faced tape which is used to secure the supporting structure to the underside of the flying disc. There are additional liner strips releasably attached to the topside of radially distal portions of the tape and opposite the discrete light sources, which are mounted on the distal portions of the respective membrane arms. These liner strips carry means for indicating locations for punching holes in the disc that will receive the light sources. The liner strips allow this punching operation to be carried out prior to securing the distal portions of the membrane arms that hold the light sources in their installed positions.

A further aspect of the invention relates to centering the main kit component on the underside of the disc by trimming the arms at preselected index marks corresponding to various sizes of flying discs and locating the component on the disc with the trimmed ends just reaching a crease that is commonly found on the underside of the discs.

Another aspect of the invention relates to providing a series circuit in the main kit component so that non-blinking LED's can be made to blink by controlling current to them through a blinking LED.

The invention also relates to a second kit component which is a die that can be inexpensively made from a hollow cylindrical casing and shaped to provide a cutting edge for cutting non-circular holes in the disc that correspond in shape to the LED's.

The invention further provides a kit that is especially suitable for installation in phosphorescent discs because the preferred, transparent membrane and preferred, transparent tape are very thin and will not interfere with observing the glow of the disc body.

The invention also relates to a method of installing discrete light sources on board a flying disc in which the supporting structure for the light sources is progressively secured to the underside of the disc beginning with the central base portion and moving radially outward, and in which the radially distal portions of membrane arms are free from the corresponding portions of the tape until holes can be punched through the tape as indexed locations. Then, by exposing adhesive on the topside of the tape, the distal portions of the arms can be secured to the disc to hold the LED's in apertures located in a particularly desirable position on the disc.

The invention provides for a flying disc with lighting circuit that is insulated and protectively covered by a transparent membrane, which allows observation of the LED's and, to a user, seems substantially flush with the underside of the disc. The LED's are rounded at one end and tapered at an opposite end, so that when exposed on the topside of the upper deck, they do not present any rough edges to be grabbed by a user.

Various objects and advantages of the invention will appear in the following description, wherein reference is made to the accompanying drawings that form a part hereof, and in which there is shown by way of illustration a preferred embodiment of the invention. This embodiment, however, does not necessarily represent the full scope of the invention, but is merely illustrative, and therefore reference is made to the claims at the end of the description for determining the scope of the invention.

DETAILED DESCRIPTION OF THE PREFERRED EMBODIMENT

Figure 1:
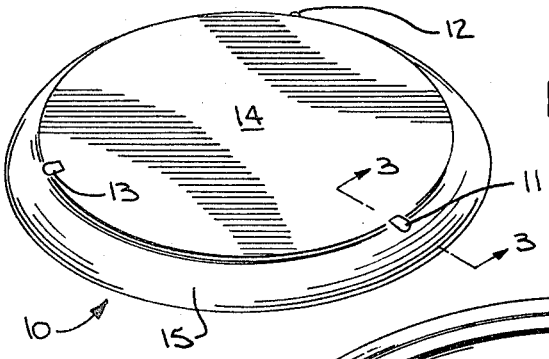
FIG. 1 is a perspective view of a lighted flying disc in which a plurality of discrete light sources have been installed with the kit of the present invention.
Figure 2:
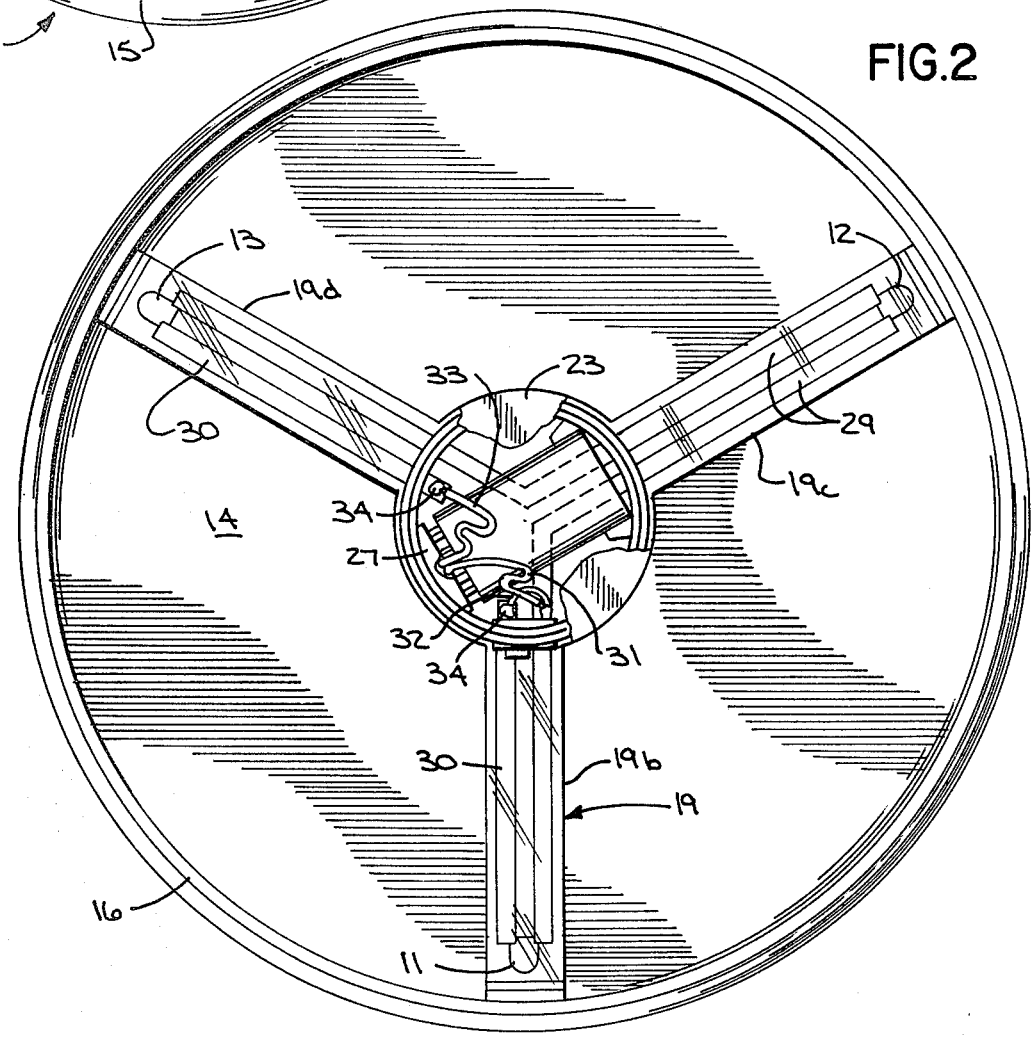
FIG. 2 is a view of the underside of the disc of FIG. 1 with a portion of a cover broken away for a better view.
Figure 3:
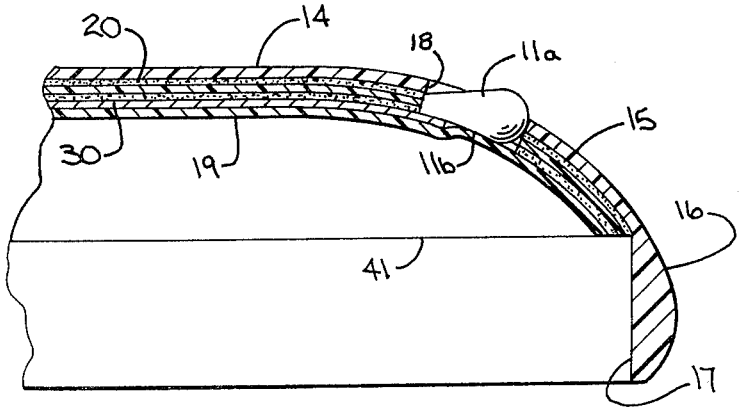
FIG. 3 is a fragmentary sectional view taken in the plane indicated by line 3—3 in FIG. 1.

FIGS. 1–3 show a flying disc 10 in which discrete light sources are provided by light emitting diodes 11–13 (LED's) that have been installed wih the kit and method of the present invention. The disc 10 is typically made of ABS (acrylonitrile-butadiene-styrene) plastic and has an upper deck with a flat central area 14 extending over its largest part. At the outer reaches of this area 14 there may be a series of ridges and grooves (not shown) which contribute to the aerodynamic characteristics of the disc as an airfoil. As seen best in FIG. 3, the upper deck also has a leading edge 15 around the outside of the flat area 14, and this edge 15 curves downwardly from the flat area 14 to a rim 16 that depends from the upper deck. The rim 16 is reinforced to a greater thickness than the upper deck and has a substantially flat, vertical interior wall 17, which encircles a portion of the cavity formed in the disc 10 and allows the rim 16 to be more easily grasped by a human thrower or catcher.

The three LED's 11–13 are angularly spaced 120 degrees apart as seen in FIGS. 1 and 2, and are located in holes 18 in the leading edge of the upper deck as seen best in FIG. 3. There, it can be seen that each LED 11–13 has been trimmed to provide a twenty degree taper 11*a* from the middle to the rear of its topside and a fifteen degree taper 11*b* from just behind its rounded nose to the rear of its bottom side. These tapers provide a low profile for the LED 11, without rough edges, when positioned in the locating holes 18 as seen in FIG. 3. The LED's 11–13 are spaced inwardly from the rim 16 by at least the thickness of an average human fingertip, so as to be out of the way when the disc 10 is being gripped on its rim 16 by a human thrower or catcher.

Still referring to FIG. 3, the LED's 11–13 are held in place by a flat, transparent, flexible membrane 19 of insulating material that is secured to the underside of the upper deck by double-faced adhesive tape 20 of a type suitable for use with the material of the disc 10. The membrane 19 is preferably cut from a sheet of transparent polyester film with a thickness of 0.007 inches. The tape is preferably made of polyester film that has an acrylic adhesive on both sides and a thickness of about 0.002 inches. Opaque tapes can also be used but these may affect the appearance of phosphorescent discs. The thicknesses of these membrane 19 and tape 20 has been exaggerated somewhat in FIG. 3, so as to be more clearly visible.

Figure 4:
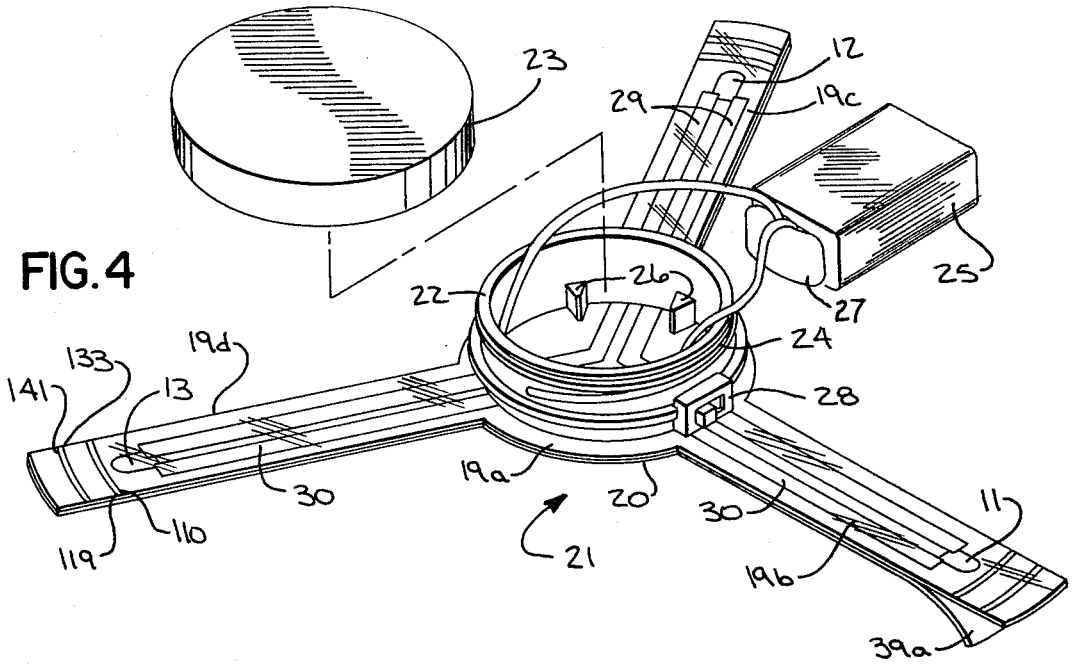
FIG. 4 is a partially exploded, perspective view of the primary kit component of the invention.

The LED's 11–13, the membrane 19 and the tape 20 are installed as a single component 21 as seen in FIG. 4. The membrane 19 has a circular base 19*a* at its hub and three, elongated rectangular arms 19*b*–19*d* extending radially outward from the base 19*a*. The tape 20 is of the same shape as the membrane 19 and is secured to the underside of the membrane 19 so that only an edge is seen in FIG. 4.

The membrane base 19*a* carries a two-piece power source enclosure formed by a cylindrical tubular body 22 and a screw-on cap 23. The tubular body 22 is made of a polyethylene or other strong plastic material and has a central cavity in its interior that opens to the front and to the rear. The back edge of the enclosure body 22 is adhesively attached to the membrane base 19 to close the rear opening into the body cavity. The cap 23 is also made of a polyethylene material and has threads (not shown) which engage threads 24 formed on the outer wall of the enclosure body 22 to become attached thereto and close the front opening. The body cavity is large enough to receive a conventional nine-volt dry cell battery 25, which can be provided separately from the kit component 21.

A pair of wedge-shaped abutments 26 are mounted on the inside wall of the enclosure body 22 and project into the body cavity in spaced apart relationship to assist in retaining the battery 25 in place during flight of the disc 10. A conventional battery terminal connector 27 is provided for attachment to the battery terminals, and when this connector 27 is wedged between the top of the battery 25 and the inside wall of the enclosure body 22, as seen in FIG. 2, it also assists in retaining the battery 25 in place.

Referring now to FIGS. 2, 3 and 4, the battery 25 is connected in series with a slide switch 28 and the LED's 11–13 by flat conductive strips 29 and 30 of copper foil and several lead wires 31–33. The conductive strips 29 and 30 are captured between the membrane 19 and the tape 20 as seen best in FIG. 3. The thickness of the conductive strips 29 and 30 has been exaggerated somewhat in FIG. 3 for a better view. As seen best in FIG. 2, there are two long conductive strips 29 and two shorter conductive strips 30. The first long strip 29 has a first radial portion extending from the membrane base 19*a* to the first LED 11 and a second radial portion extending from a junction on the base 19*a* with the first portion out to a connection to the second LED 12. The second long strip 29 also has two radially extending portions 120 degrees apart, with the distal end of one portion being connected to the second LED 12 and the distal end of the second portion being connected to the third LED 13. The shorter conductive strips 30 extend radially from a pair of solder connections 34 seen in FIG. 2 outward along respective membrane arms 19*b* and 19*d* to the first and third LED's 11 and 13, respectively. The solder connections 34 are made to termination portions of the conductive strips 30 that are underneath the membrane base 19*a*. Leads 32 and 33 extend through small openings in the base 19*a* to connect the battery 25 and switch 28 in series with the LED's 11–13 through these connections 34.

Referring to FIG. 2, the series circuit can be traced as follows. A first lead 31 that is part of the battery terminal connector 27 connects one side of the battery 25 to one side of the switch 28. A second lead 32 connects the other side of the switch 28 through the conductive strip 29 to the first LED 11. The first LED 11 is connected to the second LED 12 through the first long strip 29, and the second LED 12 is connected to the third LED 13 through the second long strip 29. The second short strip 30 connects the third LED 13 to the last lead 33 which is connected to the other side of the battery 25. For greater security, leads 31 and 33 can be anchored to the inside wall of the enclosure body 22 to protect the solder joints 34.

Although a series circuit is not mandatory for practicing the invention, it is preferred in order that a first blinking LED 11 be used with two non-blinking LED's 12 and 13. Using a series circuit, the interruption of current in the circuit by the first LED 11 also interrupts current to the second and third LED's 12 and 13, so that the three LED's 11–13 will blink in unison. The LED's 11–13 are soldered to the distal ends of the conductive strips 29 and 30 to provide both an electrical and mechanical connection. The LED's 11–13 are also supported by the spot application of adhesive between each LED 11–13 and its respective membrane arm 19*b*–19*d*.

Figure 5:
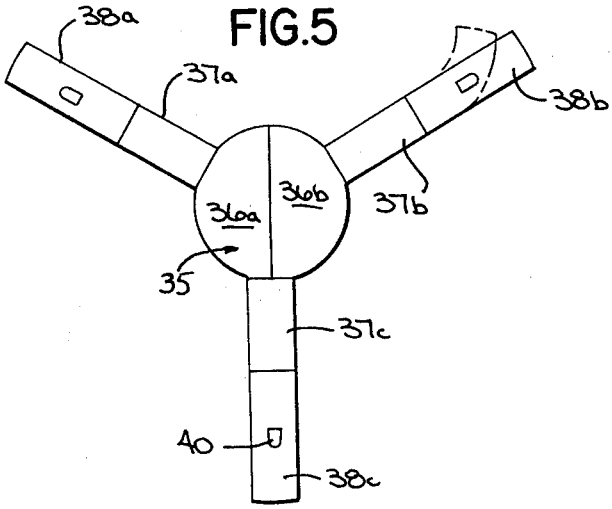
FIG. 5 is a bottom view of the kit component of FIG. 4.
Figure 7:
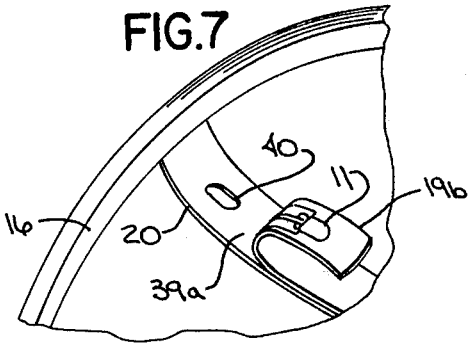
FIG. 7 is a detail view of one arm of the kit component of FIG. 4 as it is being installed in a flying disc.

To allow the kit component 21 of FIG. 4 to be handled during installation, the underside of the double-faced tape 20 is covered with a segmented liner 35 seen in FIG. 5. The segments of this liner 35 are made of paper having a silicone-based release coating on the side in contact with the adhesive, which allows each segment to be peeled off to expose the adhesive on the underside of the tape. A pair of semicircular segments 36*a* and 36*b* are used to cover the underside of the membrane base 19*a*. Three other segments 37*a*–37*c* are used to cover the underside of the tape portions corresponding to the radially adjacent portions of the membrane arm 19*b*–19*d* that are next to the base 19*a*. Three other segments 38*a*–38*c* are used to cover the underside of the portions of the tape corresponding to the radially distal portions of the membrane arms 19*b*–19*d*. For reasons that will become apparent later, the distal portions of the tape 20 are to be kept separate from the distal portions of the membrane arms during installation, and therefore additional liner segments 39*a*–39*c* are provided for the topsides of these distal portions as illustrated in FIGS. 4 and 7. The liner segments 38*a*–*38c* and 39*a*–39*c* as well as the tape 20, have apertures 40 therein corresponding to the shape of the LED's 11–13 and located to receive the LED's 11–13 therethrough.

Figure 6:
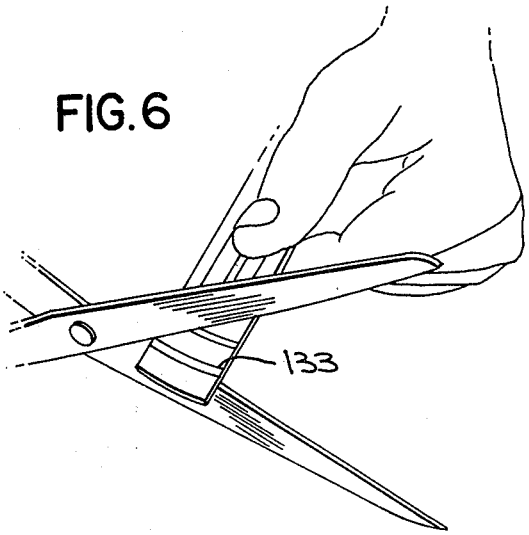
FIG. 6 is a view of a method step in trimming the ends of the arms of the kit component of FIG. 4.

In preparation for installing the main kit component 21, reference is made to the indicia 110, 119, 133 across the distal end of the membrane arms 19*b*19*d*, as seen in FIGS. 2, 4 and 6. These indicia are positioned at different radial distances from the center of the kit component 21, the nearest of these marks corresponding to the length of the arms for a 110-gram flying disc. Succeeding index marks are provided for arm lengths for flying discs of the 119, 133, and 141-gram sizes. For 150-gram and 165-gram sizes, the full length of the membrane arms 19*b*–19*d* is utilized. The example illustrated here is a flying disc 10 of the 133-gram size. Therefore, in a preliminary step the tips of the arms and underlying portions of the masked tape 20 are trimmed, preferably with a scissors as illustrated in FIG. 6. After the arms 19*b*19*d* have been shortened to the appropriate length, the disc 10 is placed upside down as seen in FIG. 2 and the kit component 21 is centered thereon, with the tips of the radial arms 19*b*19*d* extending to a crease 41 seen in FIG. 3 separating the underside of the leading edge 15 from the rim 16. With the kit component 21 in this position an outline can be traced on the underside of the disc 10 along the edges of the base 19*a* and the arms 19*b*–19*d*.

The next step is to peel off the semicircular liner segments 36*a* and 36*b* and adhesively attach the base 19*a* to the area of corresponding shape marked lightly on the underside of the disc 10. The arms 19*b* and 19*d* may be radially oriented with the outline, but as long as the base 19*a* is centered, radial alignment of the arms 19*b*–19*d* is optional. The primary purpose of the outline is to center the kit component 21 rather than to orient its radial arms 19*b*–19*d*.

Taking one arm at a time the liner segments 37*a*–37*c* and 38*a*–38*c* on the radially adjacent and radial distal portions of the liner are removed to fully secure the tape 20 and partially secure the membrane 19 on the underside of the disc 10. This will locate the apertures 40 in the tape 20 as seen in FIG. 7.

Figure 8:
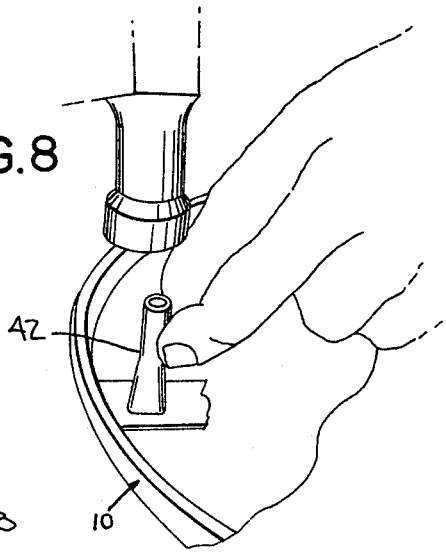
FIG. 8 is a detail view showing a method step wherein a hole is punched with a die through the masked tape of the kit component in FIG. 4.
Figure 9:
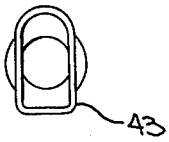
FIG. 9 is an end view of the die seen in FIG. 8.

To punch a hole in the location marked by the tape in FIG. 7, a die 42 is also provided with the kit. This die 42 is preferably in the form of a hollow casing that is about two inches along with an upper cylindrical portion and a portion shaped at its lower end as seen in FIG. 9 to provide a cutting edge 43. This edge has a rounded portion at its front and a pair of corners at its back to cut a hole out corresponding to the shape of typical LED's. The die 42 is positioned in the aperture 40 in the tape 20 as seen in FIG. 8 and a hammer or other striking implement is used to provide a sharp blow and cleanly cut a hole 18 of the correct shape in the flying disc 10.

Next, the upper liner segments 39*a*–39*c* are removed one at a time from the distal portions of the tape 20 underlying each arm 19*b*–19*d*. When the distal portion of each 19*b*–19*d* arm is pressed down upon the topside of the adhesive tape 20 it will become secured by the tape 20 as the LED's 11–13 are popped through the hole 18 cut in the flying disc 10.

The position of the LED's 11–13 in the upper deck has been preselected so that in the above-mentioned sizes of flying discs, the LED's 11–13 will project through the upper deck and be visible from the top of the flying disc 10, from points radially outward of the flying disc, and—by virtue of the clear, transparent membrane and transparent tape—from the bottom of the flying disc 10. The tapering of the LED's and the roundness of their noses provides a relatively smooth surface in the event that a user inadvertently slides a fingertip over them.

The battery need not be installed until the kit has been attached to the flying disc as seen in FIG. 2. The die in FIG. 8 is shorter than the battery so that it can be conveniently packaged in the enclosure for commercial distribution.

The invention provides a lighting adapter kit for installation of low profile light sources in the upper deck of a flying disc. The kit also positions the LED's away from the hands of users that might grasp and interfere with the electrical components. The main kit component 21 is lightweight and radially balanced and the disc 10 retains all sailing characteristics in flight.

I claim:

1. In an illumination kit for installation of discrete light sources in a flying disc, a kit component comprising:

a transparent membrane of insulating material having a central base and a plurality of arms extending radially outward from the base;

a plurality of discrete, electrically powered light sources each mounted on a distal portion of a respective membrane arm;

a set of conductive strips secured to the underside of the membrane, a pair of the strips extending from the base to a radially distal portion of each respective arm where the strips are connected to a respective one of the light sources, two of the conductive strips having termination portions positioned under the base of the membrane;

power source retaining means attached to the topside of the membrane base to house a power source and provide electrical connections between the power source and the termination portions of the conductive strips;

a layer of double-faced adhesive tape secured to the underside of the base, the conductive strips and the portion of each arm radially adjacent the base, the tape having radially distal portions that are separated from radially distal portions of the arms;

a segmented liner releasably attached to the underside of the tape; and liner strips releasably attached to the topside of the radially distal portions of the tape opposite the membrane, these liner strips each including means opposite a respective light source on the distal portion of a respective membrane arm for indicating the position of the respective light source, so that a hole can be punched in the disc at the indicated position, the liner strip removed, and the light source secured in position within the hole.

2. The kit component of claim 1, wherein the membrane arms include indicia at varying radial distances from the center of the kit component to indicate the length to which the arms should be trimmed to fit the discs of different respective sizes.

3. The kit component of claim 1, wherein the conductive strips are arranged to connect the light sources in series and wherein the first discrete light source is of an intermittent type that alternatively interrupts and transmits current to the other discrete light sources.

4. The combination of the kit component of claim 1 with a second kit component comprising a die formed by a hollow casing that is cylindrical at one end and has a cutting edge formed around an opening at the other end, the edge being shaped to cut a hole in the disc of a shape corresponding to the shape of a light source.

5. The kit component of claim 1, wherein the layer of adhesive tape is transparent, so any luminescence from the material of the disc can be observed through the membrane and tape.

6. A method of installing discrete light sources on board a flying disc together with a supporting structure having a base for carrying a power source and arms extending radially from the base to carry light sources and the circuitry for connecting the light sources to the power source, the method comprising:

exposing adhesive on the underside of double-faced adhesive tape that is secured on its topside to the base and to the radially adjacent portions of the arms extending from the base;

adhesively attaching the base to the center of the flying disc;

adhesively attaching the radially adjacent portions of the arms to the flying disc;

adhesively attaching radially distal portions of the underside of the tape to the flying disc;

punching holes in the disc through the radially distal portions of the tape at locations opposite the locations of the light sources on the underside of the arms;

exposing the adhesive on the topside of the radially distal portions of the tape; and securing the radially distal portions of the arms to the adhesive on the radially distal portions of the tape while inserting the light sources into position within the holes punched in the disc.

7. The method of claim 6, wherein the adhesive is exposed on the topside of the radially distal portions of the tape by removing releasable liner strips therefrom.

8. The method of claim 7, wherein the adhesive is exposed on the underside of the double-faced adhesive tape by removing releasable liner segments starting at the base and progressing radially outward therefrom.

9. The method of claim 6, further comprising:

the step of trimming the arms to a length indicated by index marks on the arms that are proportional to the size of the flying disc selected for installation of the light sources;

further comprising the step of placing the supporting structure on the underside of the flying disc with the ends of the arms extending to a crease between the upper deck of the flying disc and a depending rim; and further comprising the step of marking the disc along an edge of the base to indicate a central location for the supporting structure on the underside of the disc.

10. An illuminated flying disc which comprises:

a disc-shaped upper deck terminating in a downwardly curving leading edge and having a plurality of holes for locating a corresponding plurality of discrete light sources;

a rim depending from the outer periphery of the leading edge, and together with the leading edge defining a downwardly opening cavity along the underside of the upper deck;

power source retaining means generally centrally located on the underside of the upper deck for supporting, and providing electrical connection to, a power source;

a plurality of discrete light sources located in the holes in the upper deck, these holes and the light sources being spaced inwardly from the rim by the thickness of a human fingertip, the light sources projecting from the holes to be visible from above and from points radially outward from the upper deck;

a plurality of flat conductive strips electrically connecting the light sources to the power source retaining means; and a transparent membrane of insulating material secured to the underside of the upper deck to provide a protective covering for the conductive strips and the light sources that is substantially flush with the underside of the deck, while permitting observation of the light sources from underneath the disc.

11. The flying disc of claim 10, in which the discrete light sources are rounded at one end and tapered at the opposite end, to permit exposure on the topside of the upper deck without presenting rough edges that could be grabbed.

* * * * *